US006712123B1

(12) United States Patent
Weyer et al.

(10) Patent No.: US 6,712,123 B1
(45) Date of Patent: Mar. 30, 2004

(54) METHOD AND DEVICE FOR CHANGE OF SECTION OF A BILLET OF A CONTINUOUS CASTING PLANT DURING CONTINUOUS CASTING

(75) Inventors: Axel Weyer, Wuppertal (DE); Dirk Letzel, Ratingen (DE); Reiner Külchen, Krefeld (DE); Adolf Zajber, Langenfeld (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/615,097

(22) Filed: Jul. 13, 2000

(30) Foreign Application Priority Data

Jul. 17, 1999 (DE) ..... 199 33 635

(51) Int. Cl.[7] ..... B22D 11/20
(52) U.S. Cl. ..... 164/454; 164/413; 164/442
(58) Field of Search ..... 164/441, 442, 164/484, 413, 454

(56) References Cited

U.S. PATENT DOCUMENTS

| | | | | |
|---|---|---|---|---|
| 4,480,680 A | * | 11/1984 | Scheurecker et al. | 164/442 |
| 5,511,606 A | * | 4/1996 | Streubel | 164/476 |
| 5,577,548 A | * | 11/1996 | Hohenbichler et al. | 164/452 |
| 6,209,619 B1 | * | 4/2001 | Morwald et al. | 164/454 |

FOREIGN PATENT DOCUMENTS

| | | |
|---|---|---|
| DE | 4338805 | 10/1995 |
| DE | 196 39 297 A1 | 3/1998 |
| EP | 0450391 | 5/1995 |
| EP | 0743116 | 11/1996 |
| FR | 2447764 | * 10/1980 |
| JP | 60-21150 | * 2/1985 |

* cited by examiner

*Primary Examiner*—Alexandra Elve
*Assistant Examiner*—Len Tran
(74) *Attorney, Agent, or Firm*—Friedrich Kueffner

(57) ABSTRACT

In a method for changing the section of a billet of a continuous casting plant during continuous casting, wherein opposed sides of the billet are in contact with oppositely positioned roll supports arranged below a continuous casting die, wherein the roll supports are comprised of segments having rolls, wherein adjoining ones of the segments of each roll support are connected to one another by a jointed connection and wherein each segment is configured to be adjustable independent of the other segments with respect to an angular position relative to the billet, and wherein in an initial position the segments of the roll supports are adjusted to a uniform billet section, a thickness reduction can be achieved by advancing sequentially in a direction of continuous casting the segments toward the billet by moving the jointed connections toward the billet in a controlled sequence of adjusting steps or a thickness increase can be achieved by moving sequentially in a direction of continuous casting the segments away from the billet by moving the jointed connections away from the billet in a controlled sequence of adjusting steps.

2 Claims, 2 Drawing Sheets

METHOD AND DEVICE FOR CHANGE OF SECTION OF A BILLET OF A CONTINUOUS CASTING PLANT DURING CONTINUOUS CASTING

BACKGROUND OF THE INVENTION

1. Field of the Invention

The invention relates to a method for changing the section of a billet of a continuous casting plant during continuous casting operation wherein opposed sides of the billet are in operative contact with oppositely arranged roll supports positioned below a casting die, wherein the roll supports are divided into sequentially arranged segments that support rolls and are connected to one another by jointed connections, wherein each segment is independently adjustable with regard to an angle relative to the billet, and wherein in an initial position the billet guide to be changed is adjusted to a uniform production format thickness (section of the billet). The invention also relates to a device for performing the method.

2. Description of the Related Art

The change of section of a billet in continuous casting plants during the continuous casting operation is an absolute requirement for optimizing production. However, in the past it was necessary,to reduce the casting speed for a period of time for the purpose of thickness (section) reduction or thickness (section) increase. This results in production losses, and the entire course of the production is at least momentarily thrown off balance. Moreover, in the currently practiced methods it is only possible to perform a fixedly adjusted, stepped change of section.

The patent document EP 0 450 391 B1 discloses a device for supporting a metal billet, especially for soft reduction, in a strip casting plant wherein below the continuous casting die on both sides of the billet mirror-symmetrically and oppositely arranged roll supports are provided whose rolls are in operative contact with the billet. Each roll support is arranged on a stationary frame and divided into several roll-supporting segments which are connected to adjusting devices. The roll-supporting segments are connected with articulation to one another such that each segment can be independently adjusted at any desired angle relative to the billet and fixed in this position, wherein the upper adjusting device is used for the general adjustment of the roll support. This adjusting device can be a mechanical, a hydraulic or a mechanic-hydraulic adjusting device.

The patent document DE 43 38 805 C2 discloses a method and a device for operating a continuous casting plant, especially for cast-on of a continuous casting plant for producing thin slabs for hot strip rolling, with at least one reduction roll pair arranged downstream of the continuous casting die. Moveable thin slab guiding elements are positioned downstream of the reduction roll pair. The reduction roll pair is adjusted, after a predetermined length of the hot strip has passed through, to a smaller gap width which results in squeezing off of the liquid phase. The hot strip is shaped to a cast-on format having a thickness which is less than the thickness of the desired final format. The strip guiding elements, respectively, the reduction roll pair, are subsequently, preferably successively, adjusted to the thickness of the final format as soon as the cast-on format of reduced thickness is completely positioned within their adjusting area. The reduction roll pair is pressure-controlled and is positioned in accordance with the final format after the strip guiding elements have been advanced.

The patent document EP 0 743 116 A1 discloses a vertical casting production line for billets, comprising a casting die as well as a component group with foot rolls downstream of the exit of the casting die, moreover a plurality of guiding units, a correlated vertical roll segment as well as a driver arrangement in connection with a horizontal segment of the casting production line. The guiding units comprise at least the entire vertical segment of the casting production line wherein at least a portion of the rolls of the guiding elements cooperate with adjusting devices which are controlled by a process data unit in order to ensure a controllable soft reduction at least in the second part of the vertical segments.

The patent document DE 196 39 297 A1 discloses a method and a device for high-speed continuous casting plants with a billet thickness reduction during solidification. In the method and the corresponding device for continuous casting of billets whose cross-section is reduced during the solidification, wherein casting is preferably performed with an oscillating casting die, the billet cross-section is reduced linearly along a minimal length of the billet guide directly below the casting die. By means of the subsequent further billet cross-section reduction along the remaining billet guide, the so-called soft reduction, up to a point maximally directly before the final solidification or the liquid phase tip, a critical deformation of the billet can be prevented by taking into consideration the casting speed as well as the steel quality.

SUMMARY OF THE INVENTION

It is an object of the present invention to provide a method as well as a device suitable for performing the method for format thickness change (change of section) of the billet of a continuous casting plant during continuous casting, in which the casting speed for the transitional process to the change of section is not reduced, i.e., constant production and casting conditions are maintained. The transitional length of the billet during the change a section is to be shortened for the purpose of avoiding production losses. In all transitional situations of the change of section an optimal billet support is to be ensured for reducing break-out risks.

In accordance with the present invention, this is achieved in that the change of section is carried out in a controlled sequence of adjusting steps of the segments, in particular, in that

- a sequential advancement of the sequentially arranged segments at their jointed connections in the casting direction is performed for reducing the format thickness or section, and
- a sequential moving away of the sequentially arranged segments at their jointed connections in the casting direction is performed for increasing the format thickness or section.

With the disclosed course of the method for a change of section for continuous casting plants the following is achieved:

- the casting speed is not reduced for the transition so that an increase of the production output in comparison to the prior art as well as constant production and casting conditions result;
- the transition length of the billet to be produced is shortened so that production losses are reduced;
- the thickness or section changes can be performed with continuously selectable values in a wide adjusting range as a function of the production program and this results in a high flexibility of the plant;
- for a reduced material thickness with continuously reduced wedge shape the roll skirt provides a sufficient billet support wherein the exit side is readjusted according to the material thickness, while for format thickness increase it is achieved that with increased material thickness as a result of the increasing wedge shape the roll skirt provides a sufficient support for the billet and the exit side is readjusted according to the material thickness.

In a further embodiment of the method it is suggested that for a format thickness reduction with constant casting speed, wherein the solidification point of the billet 9 is, for example, in the segment n=3, the exit side of the first segment n=1 is advanced via the jointed connection with the inlet side of the segment n=2 by set-point control in a first adjusting phase, and, after reaching the target position, i.e., the segment position for the target format, the exit side of the segment n=2 is advanced together with the inlet side of the segment n=3 in a second adjusting phase, and in a sequence of identical steps the adjustments of the segments n=3, 4 to i to the target position is carried out.

According to another embodiment of the invention, it is proposed that for a format thickness increase at constant casting speed, wherein the liquid phase tip of the billet is, for example, located in the segment n=3, first the exit side of the segment n=1 is moved away at the jointed connection together with the inlet side of the segment n=2 by set-point control in a first adjusting phase, and, after reaching the target position, i.e., the segment position for the target format, the exit side of the segment n=2 together with the inlet side of the segment n=3 is moved away in a second adjusting phase, and in a sequence of identical steps the adjustment of the segments n=3, 4 to i to the target position is carried out.

According to a further embodiment of the method of the invention, it is proposed that the advancing of the segments is carried out with constant speed by dynamic position control, wherein a predetermined force threshold value is not surpassed.

Moreover, it is suggested according to the invention to calculate the adjusting speed of the segments by taking into consideration the permissible billet elongation limit and the current casting speed in connection with the current format adjustment, respectively, according to the resulting volume flow of the billet. Advantageously, the adjusting speed is calculated via the current casting speed, the segment length, and the required adjusting stroke according to the equation $$V=Ds/Ls*Vcast$$

wherein Ds is the format thickness change (change of section), Ls is the segment length, and Vcast is the current casting speed.

Further developments of the method propose that the adjusting process is monitored, for example, by the current cylinder pressures of hydraulic adjusting devices and, when a threshold value is surpassed, the method switches from position control to force control and, after reaching the target position, switches back to position control.

Finally, it is suggested that the respective adjusting speeds of the exit side and the inlet side of adjoining segments are inevitably synchronous due to the jointed connection of the exit side of the segment with the inlet side of the adjoining segment.

In a device for format thickness change of the billet of a continuous casting plant, wherein opposed sides of the billet are in operative contact with oppositely arranged roll supports below the casting die, wherein the roll supports are divided into sequentially arranged segments that support rolls and are connected to one another by jointed connections, and wherein each segment is independently adjustable with regard to an angle relative to the billet, the adjusting devices are advantageously provided with means for position or force control. Expediently, the segments are in cooperative connection with controlled and direction-reversing hydraulic cylinders in the area of their jointed connections between the exit side and the inlet side.

DESCRIPTION OF THE PREFERRED EMBODIMENTS

Figure 1:
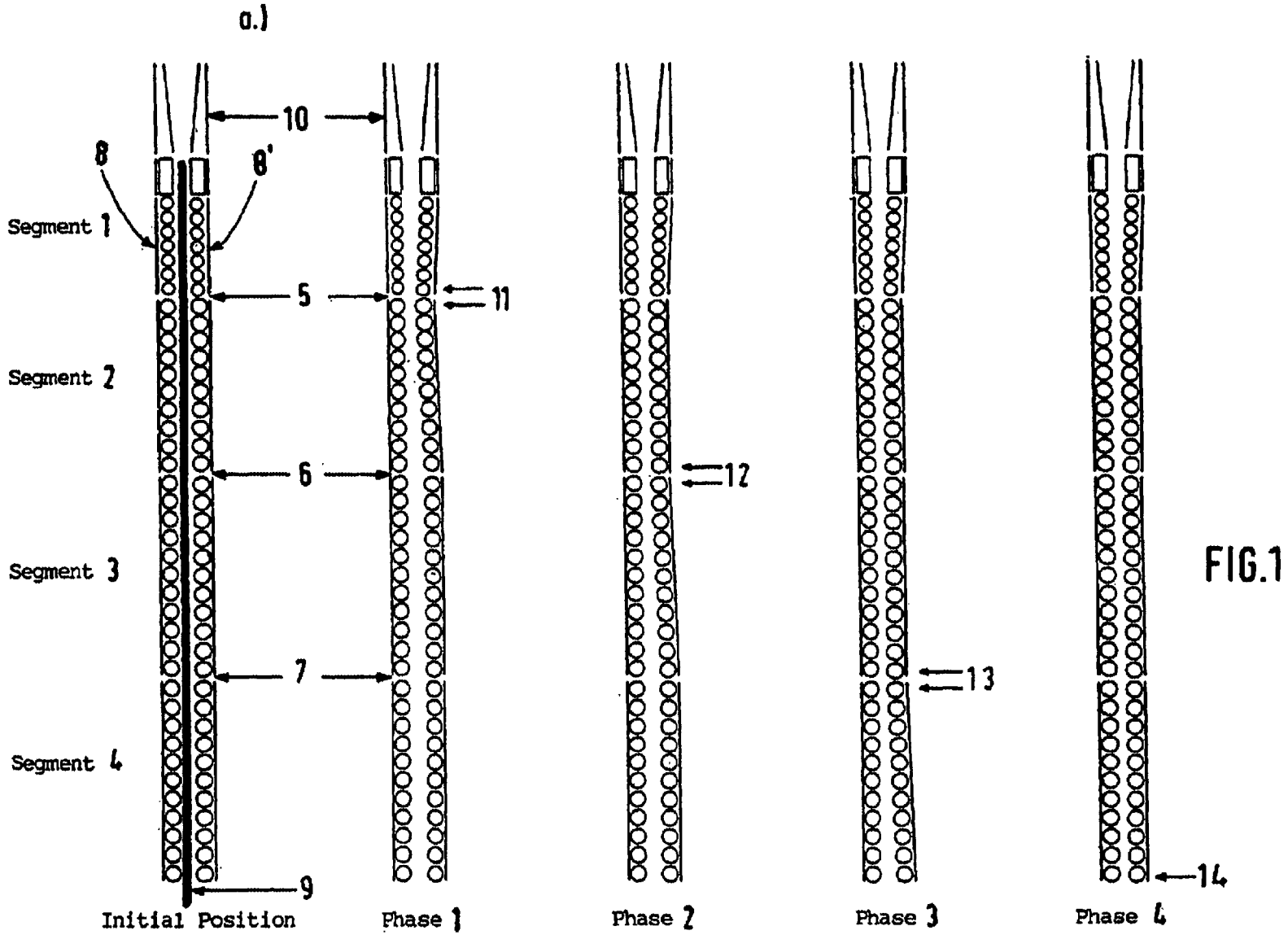
FIG. 1 shows the sequence of adjusting steps of the method according to the invention, illustrated in sequential phases, for format thickness reduction.

FIG. 1 shows the individual method steps of the method according to the invention for a format thickness reduction of the billet 9 of a continuous casting plant in continuous casting operation. Below the casting die 10 the billet 9 is in operative contact on both opposite sides with mirror-symmetrically arranged roll supports 8, 8' which are divided into sequentially arranged roll-supporting segments 1 through 4 connected to one another by jointed connections 5 through 7. Each segment 1 through 4 is adjustable independently with respect to its angled position relative to the billet 9. In an initial position the entire billet guide comprised of the roll supports is adjusted to a uniform production format thickness as illustrated in the initial position (to the left in FIG. 1). The format thickness change (change of section) is performed in a controlled sequence of adjusting steps of the segments 1 through 4. The format thickness reduction is carried out by sequentially advancing the sequentially arranged segments 1 through 4 in the casting direction; this is illustrated by the phases 1 through 4 of FIG. 1. Beginning with the exit side of the segment 1 the jointed connection 5, together with inlet side of segment 2, is advanced by set-point control.

After reaching the target position, i.e., the segment position for the target section, the exit side of the segment 2 and the inlet side of the segment 3 are advanced in a second adjusting step, and in a sequence of identical steps the adjustment of the segments 3 and 4 is performed according to the illustrated phases 3 and 4. For this purpose, force-applying means 11 act on the jointed connection 5 in the direction of reducing the billet 9, followed in the phase 2 by the action of the adjusting device 12 in the direction of reducing the billet cross-section, and further sequentially in phase 3 and phase 4 by the action of the adjusting devices 13 and 14 until a continuous overall reduced format thickness is reached according to the final state of phase 4.

Based on the illustration of the course of the method for a format thickness reduction illustrated in FIG. 1, in the initial position present before the phase 1 the entire billet guide (roll supports) is adjusted to a production thickness X during the casting operation. The casting speed is constant; the liquid phase tip (solidification point) is within the segment 3.

For starting the thickness reduction according to phase 1, as has been mentioned before, the exit side of the segment 1 and the inlet side of the segment 2 are advanced with constant speed by dynamic position control by means of set-point control. A predetermined force threshold value is not surpassed. The advancing speed is calculated taking into consideration the permissible billet elongation limit and the current casting speed in connection with the current format adjustment, respectively, according to the thus resulting volume flow of the billet.

The adjusting speed to be maintained is calculated based on the current casting speed, the segment length, and the required adjusting stroke according to the equation $$V=Ds/Ls*Vcast$$

wherein Ds is the format thickness change, Ls is the segment length, and Vcast is the current casting speed.

An effective force monitoring action, computable, for example, via the current cylinder pressures of a hydraulic adjusting device, monitors the adjusting process. Should the force surpass a calculated threshold value or limit, the method switches from position control to force control. After reaching the target position, the method switches back to position control.

With the described course of the method, it is achieved that with reduced material thickness of the wedge shape passing through the roll skirt provides a sufficient support of the billet 9 and that the exit side is re-adjusted according to the material thickness.

The liquid phase present within the segment 1, 2 and optionally 3 is not interrupted by the process. Proper support for the billet is provided in all phases by switching from position control to force control.

Figure 2:
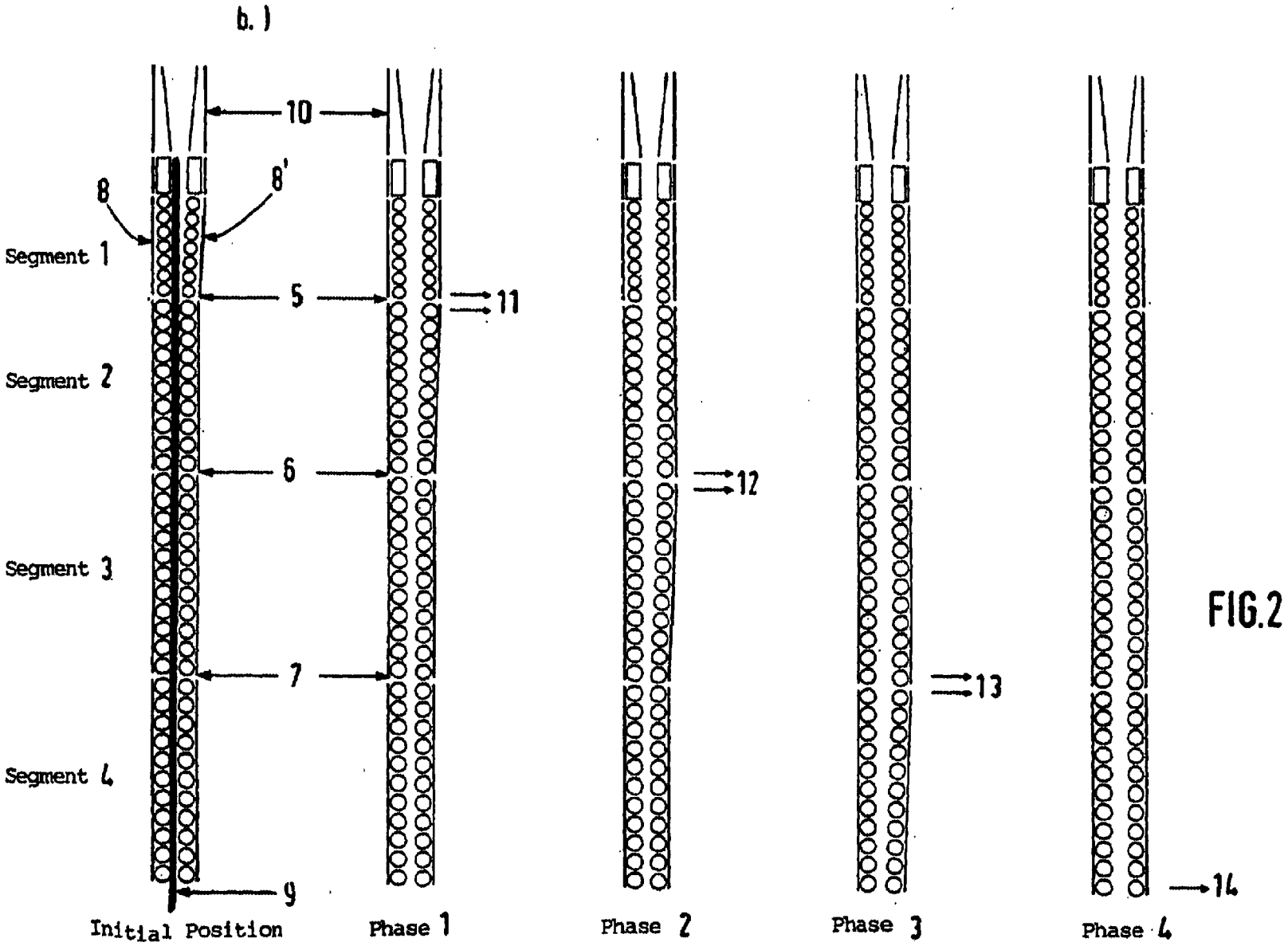
FIG. 2 shows the sequence of adjusting steps of the method according to the invention, illustrated in sequential phases, for format thickness increase.

In the following, the format thickness increase according to the representation of the method steps in FIG. 2 will be described.

First, in the initial position before the phase 1 the entire billet guide is adjusted to production thickness X in the casting operation. The casting speed is constant, the liquid phase tip (solidification point) is positioned in the segment 3. The thickness increase is started in phase 1.

As soon as the target format of the exit side of the segment 1 and of the inlet side of the segment 2 at the end of the phase 1 has been reached, the exit side of the segment 2 is moved away, i.e., the gap is widened (phase 2).

The adjusting speed is calculated based on the current casting speed, the segment length, and the required adjusting stroke in the same way as disclosed in connection with the format thickness reduction.

An effective force monitoring action, calculated by means of the current cylinder pressures of hydraulic adjusting devices, permanently controls the adjusting process.

Should the force of the calculated threshold value or limit be surpassed, the method switches from position control to force control. After reaching the target position, the method switches back to position control.

With the described course of the method, it is achieved that the roll skirt provides a sufficient support action for the billet 9 for increased material thickness with continuously increasing wedge shape and that the exit side is accordingly re-adjusted to the material thickness.

Subsequently, the inlet side of the segment 3 is moved away simultaneously with the exit side of the segment 2 at the same adjusting speed, as illustrated in phase 2 of FIG. 2, for widening the gap. The monitoring function is carried out in analogy to that of the exit side of segment 2.

As soon as the target format of the inlet side of the segment 3 has been reached, the exit side of the segment 3 and the inlet side of the segment 4 (phase 3) are moved away from the billet (gap is widened). The calculation of the casting speed and the monitoring action are carried out as disclosed above.

As soon as the target format of the inlet side of segment 4 has been reached, the exit side of segment 4 (phase 4) is moved away from the billet. The calculation for the monitoring action is carried out as disclosed above.

While specific embodiments of the invention have been shown and described in detail to illustrate the inventive principles, it will be understood that the invention may be embodied otherwise without departing from such principles.

What is claimed is:

1. A method for changing the section of a billet of a continuous casting plant during continuous casting, wherein opposed sides of the billet are in contact with oppositely positioned roll supports arranged below a continuous casting die, wherein the roll supports are comprised of segments having rolls, wherein adjoining ones of the segments of each roll support are connected to one another by a jointed connection and wherein each segment is configured to be adjustable independent of the other segments with respect to an angular position relative to the billet, and wherein in an initial position the segments of the roll supports are adjusted to a uniform billet section; the method comprising the steps of:

advancing sequentially in a direction of continuous casting the segments toward the billet by moving the jointed connections toward the billet in a controlled sequence of adjusting steps for reducing the section of the billet; or moving sequentially in a direction of continuous casting the segments away from the billet by moving the jointed connections away from the billet in a controlled sequence of adjusting steps for increasing the section of the billet, wherein, for changing the section of the billet with a constant casting speed and with the solidification point of the billet having passed the first and second segments, an exit side of the first segment and an inlet side of the second segment in the casting direction are advanced in a first one of the adjusting steps toward or moved away from the billet by moving the first and second segments at the jointed connection connecting the first and second segments toward or away from the billet by set-point control, and after the first and second segments have reached a target position, an exit side of the second segment and an inlet side of the third segment in the casting direction are advanced in a second one of the adjusting steps toward or moved away from the billet by moving the second and third segments at the jointed connection connecting the second and third segments toward or away from the billet, and after the second and third segments have reached a target position, in further ones of the adjusting steps the third and further segments are advanced toward or moved away from the billet sequentially in the same manner until all segments have reached the target position, wherein the segments are adjusted at a constant adjusting speed with dynamic position control to a predetermined force threshold value, further comprising the step of calculating an adjusting speed of the segments for advancing or moving away the segments based on permissible billet elongation limit, the current casting speed, the current section adjustment, and the resulting volume flow of the billet, wherein, when a predetermined force threshold value is surpassed, force control is applied instead of position control and wherein, when the target position has been reached, the position control is applied again.

2. The method according to claim 1, wherein the adjusting speed is calculated, based on the current casting speed, the segment length, and the required adjusting stroke of the segments, by the equation $$V=Ds/Ls*Vcast$$

wherein Ds is the section change, Ls is the segment length, and Vcast is the current casting speed, wherein the adjusting steps are carried out by hydraulic adjusting devices, further comprising the step of monitoring the adjusting steps via current cylinder pressure of the hydraulic adjusting devices.

* * * * *